US009429311B2

(12) United States Patent
Metz et al.

(10) Patent No.: US 9,429,311 B2
(45) Date of Patent: Aug. 30, 2016

(54) LIGHTING DEVICE ON A LAUNDRY APPLIANCE

(71) Applicant: BSH BOSCH UND SIEMENS HAUSGERÄTE GmbH, München (DE)

(72) Inventors: Florian Metz, Unterföhring (DE); Carsten Weber, Aalen (DE)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/415,214

(22) PCT Filed: Jul. 2, 2013

(86) PCT No.: PCT/EP2013/063895

§ 371 (c)(1),
(2) Date: Jan. 16, 2015

(87) PCT Pub. No.: WO2014/012784

PCT Pub. Date: Jan. 23, 2014

(65) Prior Publication Data

US 2015/0176832 A1 Jun. 25, 2015

(30) Foreign Application Priority Data

Jul. 18, 2012 (DE) ..... 10 2012 212 550

(51) Int. Cl.

| | |
|---|---|
| ***F21V 33/00*** | (2006.01) |
| ***D06F 39/14*** | (2006.01) |
| ***D06F 37/26*** | (2006.01) |
| *D06F 39/00* | (2006.01) |
| *F21W 131/403* | (2006.01) |
| *F21Y 101/02* | (2006.01) |

(52) U.S. Cl.

CPC ..... *F21V 33/0044* (2013.01); *D06F 37/266* (2013.01); *D06F 39/14* (2013.01); *D06F 39/005* (2013.01); *F21W 2131/403* (2013.01); *F21Y 2101/02* (2013.01)

(58) Field of Classification Search

CPC .... D06F 37/266; D06F 39/005; D06F 39/14; F21V 33/0044; F21W 2131/403; F21Y 2101/02

USPC ..... 362/89

See application file for complete search history.

(56) References Cited

U.S. PATENT DOCUMENTS

| | | | | |
|---|---|---|---|---|
| 2010/0033949 | A1* | 2/2010 | Hering | A47L 15/4251 362/91 |
| 2011/0134627 | A1* | 6/2011 | Hamlin | F21V 33/0044 362/92 |

FOREIGN PATENT DOCUMENTS

| | | |
|---|---|---|
| DE | 10 2006 053905 | 5/2008 |
| DE | 10 2006 053906 | 5/2008 |
| WO | WO 03/023118 | 3/2003 |
| WO | WO 2008/058972 | 5/2008 |

* cited by examiner

*Primary Examiner* — Anh Mai
*Assistant Examiner* — Hana Featherly
(74) *Attorney, Agent, or Firm* — Nixon & Vanderhye P.C.

(57) ABSTRACT

To illuminate a structure 5 with informational content on components 3, 20 of a filling opening in a laundry appliance, particularly a washing machine or a washer/dryer, components 3, 20, which are made of a transparent or translucent material, have a pot-shaped laundry deflector 20 and a window cover 3 lying at least approximately flush with the front face 1 of the laundry appliance. Components 3, 20 bear lettering 4, 16 and/or a symbol to be illuminated. Light-emitting elements 6, 17 are arranged opposite lateral edge faces 10, 15 of at least one of the components 3, 20, the light beams 9, 19 emitted by said elements being directed onto the edge faces 10, 15. The lettering 4, 16 or the symbol consists of a three-dimensional structure 5 in the material with an at least microscopically small extension into the material. To specify a structural illumination in which a lower number of light sources is adequate, one of the components 3, which is located at least approximately flush with the front face 1 of the laundry appliance and which is provided with the structure 5, 16, has a light-conducting element 13 extending inwards away from the flush line, the light inlet area 15 of which element extends as an edge face to the other component 20 and is guided into the radiation range of the light-emitting element 17.

15 Claims, 2 Drawing Sheets

LIGHTING DEVICE ON A LAUNDRY APPLIANCE

Figure 1:
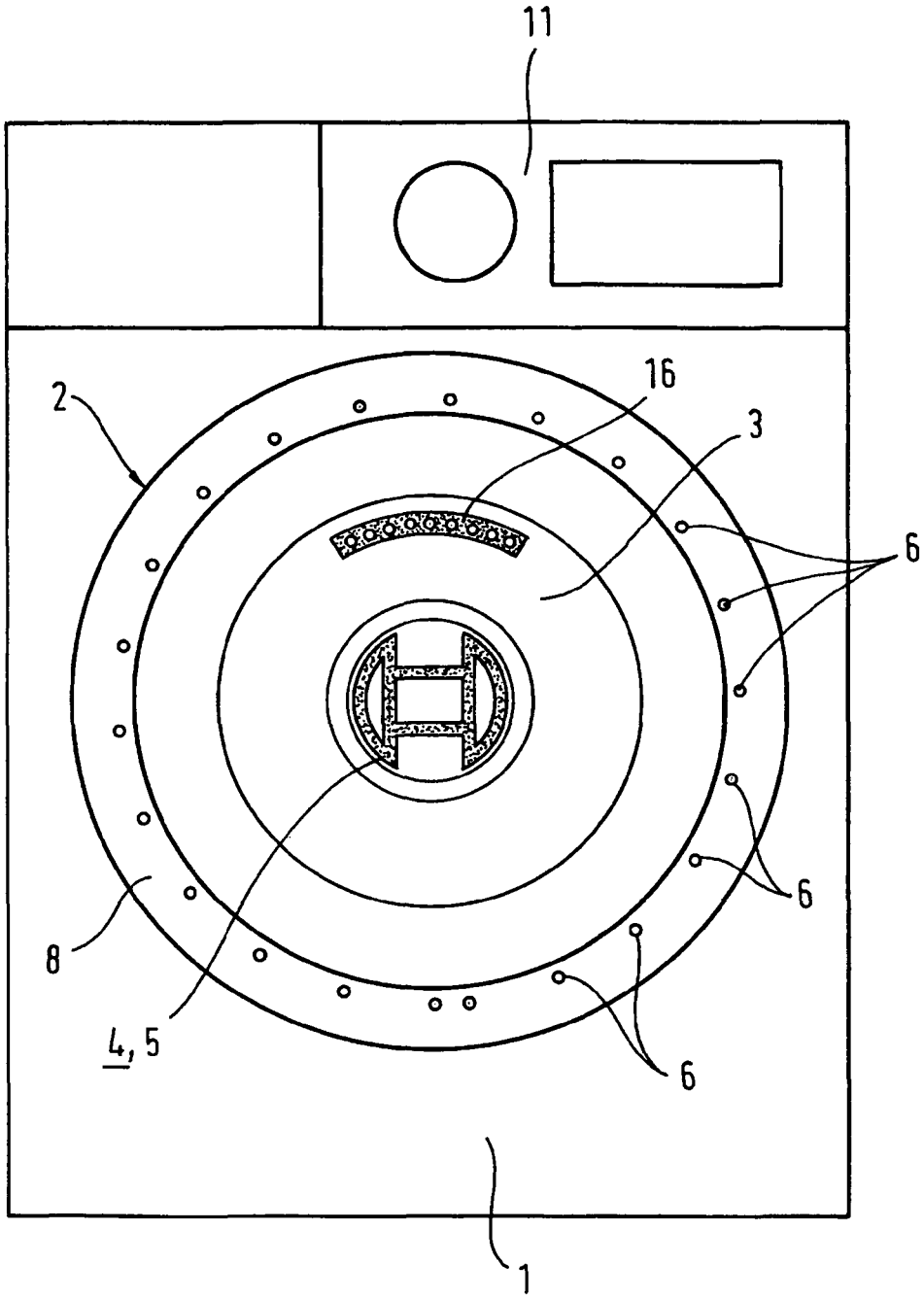

This application is the U.S. national phase of International Application No. PCT/EP2013/063895, filed 2 Jul. 2013, which designated the U.S. and claims priority to DE 10 2012 212 550.7, filed 18 Jul. 2012, the entire contents of each of which are hereby incorporated by reference.

The invention relates to a lighting device on a laundry care appliance, in particular on a washing machine or a tumble dryer, the loading opening of which has components made of a transparent or translucent material in the form of a pot-shaped laundry deflector and a window cover lying at least approximately flush with the front face of the laundry care appliance, which bear lettering and/or a symbol, wherein light-emitting elements are arranged opposite lateral edge faces of at least one of the components, the light beams emitted by said elements being directed onto the edge faces and the lettering or symbol consisting of a three-dimensional structure in the material with an at least microscopically small extension into the material.

Such a laundry care appliance is known from DE 10 2006 053 905 A1. In this light elements are arranged around a window cover, their light being radiated by way of an edge face into the transparent or translucent body of the window cover. This body contains a three-dimensional structure with an information content in its material. Such a measure means that it is possible to dispense with printing on the bullseye door for permanent information, e.g. a company name or a symbol.

As radiation into such a large component as a window cover to illuminate a structure arranged roughly in its center requires the annular arrangement of many light sources, the object of the present invention is to specify a structure illumination which can be achieved with a smaller number of light sources.

According to the characterizing portion of claim 1 this object is achieved in that one of the components, which lies at least approximately flush with the front face of the laundry care appliance and is provided with the structure, has a light-conducting element that reaches inward out of the flush line, its light entry face reaching to the other component in the manner of an edge face and being guided into the radiation region of the light-emitting element. In the most favorable instance, for example in the case of a structure with short extension, when applying the inventive measure it is possible to use just one light source, e.g. an LED, to illuminate the structure in an identifiable manner. To this end the light entry face of the light-conducting element should face toward the radiation from the light-emitting element.

In one advantageous configuration of the invention the light-emitting elements are LEDs and/or ends of light-conducting elements. They are light and remain cool enough for their surroundings and require only a small amount of energy.

In order to be able to dispense with particular components for the arrangement of light sources, in one particularly advantageous configuration of the invention the elements are integrated in a frame (sleeve 18) which encloses the transparent or translucent material. Such a frame is in any case a supporting component of a laundry care appliance and in the case of a washing machine can even consist of the sleeve that connects the opening of the machine housing to the opening of the tub in a water-tight manner.

According to a further advantageous configuration the light conducted in can be colored. It can also be possible to control the light output of the elements. This allows particular effects to be achieved to draw the attention of the observer to a greater degree.

The features of the claims can be applied individually or in combination with one another and in combination with further features that will emerge from the description in the context of the invention, where technically feasible.

Figure 2:
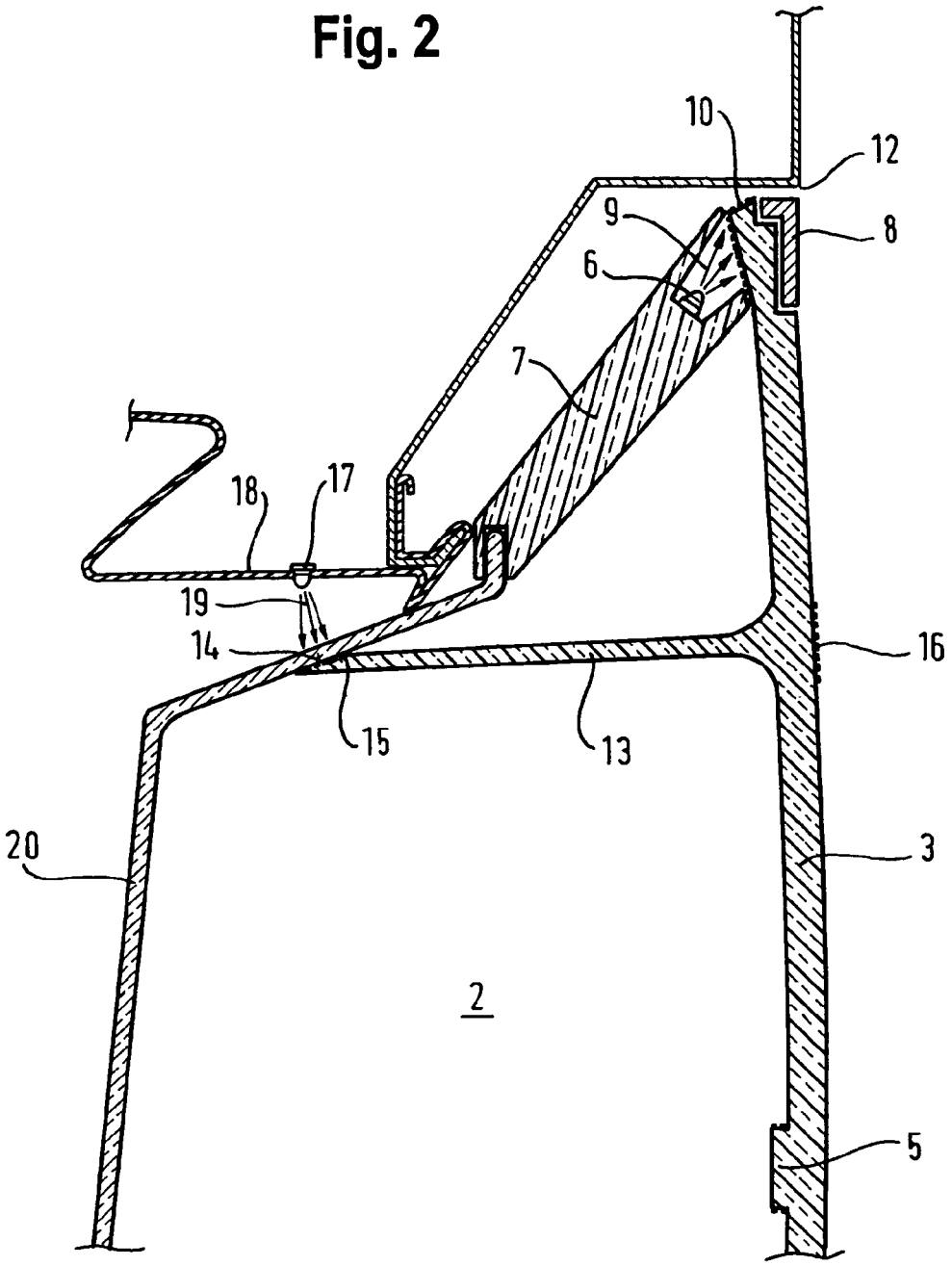

The invention is described below with reference to an exemplary embodiment illustrated in the drawing, in which FIG. 1 shows a front view of an inventively equipped washing machine and FIG. 2 shows a vertical section through a bullseye window of the washing machine according to FIG. 1.

In the front view of the washing machine in FIG. 1 the bullseye door 2 lies at least approximately flush with the front face 1 of the machine housing. The bullseye door 2 has a window cover 3 made of transparent material, e.g. plexiglass, in which a company name or logo 4, in this instance the well-known Bosch "armature within a circle" trademark, is arranged. Its characters are applied by means of a three-dimensional stamp 5 on the inside of the window cover 3 so as to avoid any inconvenient character edges and not to restrict the impact of the characters due to general soiling. The window cover 3 is produced using a pressing process. The stamp 5 of the lettering or logo 4 can be incorporated using the same pressing process, by etching or engraving into the window cover 3. In order to make the lettering or logo 4 stand out against the dark background of the unilluminated hollow space of the laundry drum light sources 6 are distributed on the periphery of the window cover 3, their radiation into the glass of the window cover 3 striking the stamp 5 and lighting it up.

The arrangement of the light sources 6 as light-emitting elements is shown in more detail in FIG. 2. In the example LEDs 6 are used as light sources, being arranged in a regularly distributed manner in direct proximity to the frame 8 of the window cover 3 in the housing frame 7, which completely encloses the bullseye door 2. The LEDs 6 have a defined radiation characteristic and are aligned in such a manner that the maximum light radiation 9 strikes the edge face 10 of the window cover 3. The selected arrangement means that only the gap between the frame 8 of the bullseye door 2 and the housing cutout 12, which is part of the front face of the machine housing of the washing machine 1, is illuminated. However said light also radiates through the material of the window cover 3 to its center and the stamp 3, which is lit up as a result. The energy supply to the LEDs 6 should be implemented in this instance by way of the hinge (not shown) of the bullseye door 2. In this embodiment the window cover 3 not only has the function of protecting from the possibly hot glass of the pot-shaped laundry deflector 20 but also the function of transporting the light energy of the LEDs 6 to the lettering or logo 4 of the stamp 5.

When side light is activated, the company name or logo 4 is illuminated brightly against the dark background of the unlit laundry drum and appears to the user to float in space. Said lettering or logo therefore stands out in a visually clear manner from pertinent characters and symbols which are located for example on the operating panel 11 of the washing machine 1. The light 9 radiating in can be of different colors, which in conjunction with for example complementary pigmentation of the translucent or transparent material, allows the characters 4 to stand out particularly effectively.

The same effects can be achieved by locating the characters 4 on the inward curving pot-shaped laundry deflector 20, which is made of a transparent material, e.g. glass. In such an example the frame 7 can be made of a translucent material, which is suitable for transmitting the light 9 radiated in by then inward-emitting LEDs 6 into the laundry deflector 20 at its edge face. This variant is recommended in the absence of a window cover 3. The characters (not shown here) should then be located on the outside of the pot-shaped laundry deflector 20. The inside therefore remains smooth and the laundry items do not rub in an unwanted manner against any edges of the stamps 5 of the letters 4 as the washing machine operates. It also prevents the sharpness of the three-dimensional character structure and therefore its perceptibility being adversely affected over time when residues originating from the laundry care process are deposited on or wear down the structures of the characters 4.

The LEDs 6 can be arranged so that they are distributed in an annular manner on the frame 8 of the window cover 3 or on the edge of the frame 7 and can be activated one after the other so that the observer perceives a circumferential halo of light. The characters 4 are also lit up with this type of radiation. This type of annular activation can also take place in such a manner that the light sources 6 are constantly supplied with a basic power, circumferentially but one after the other with a short-term pulse of higher power. This allows a regular basic brightness to be achieved for the radiated characters 4. The circumferential increase in power allows for example the movement of the laundry drum of the washing machine 1 to be simulated or displayed.

As the cross section of the laundry deflector 20 is bent into an arc multiple times because of its particular shape, losses of the light 9 radiating in by way of the edge region due to scattering cannot be avoided, so compared with a similar structure in the window cover 3 the illustrated lettering is less clearly visible at the same light intensity. In order to reduce the losses due to scattering in the arc region the rear face of the laundry deflector 20 can be provided with a reflecting coating in the arc region, which is perceived by the observer as an illuminating ring and therefore also attracts attention to a greater degree.

The inventive measure can be applied without the lighting devices described above or in combination with them. It means that the window cover 3 has a light-conducting element 13 that reaches inward out of the flush line with the front face 1 of the machine housing. Its inner end face 14 is cut at an angle and has a shape that rests closely against the conical outside of the laundry deflector 20 where possible without a gap. To this end it is highly polished or provided with a rough surface 15, the light from which is transported by the light-conducting element 13 onto a similarly rough surface, which is configured to form an information surface 16. This information surface 16 can equally contain a logo or a trademark or a type designation of the laundry care appliance, which is characterized by surface structures distinguished from the surroundings, for example by a roughness compared with the highly polished smoothness of the surroundings. In FIG. 1 the individual characters in the information surface 16 are indicated by brighter points.

To this end the light-conducting element 13 can form a cylinder jacket segment, if the information surface 16 is to have a crescent shape as in FIG. 1 for example. However the information surface 16 can also have any other shape, e.g. a rectangular shape. To this end the light-conducting element 13 must undergo a continuous transformation of its cross section from the crescent shape to the rectangular shape or to the other selected shape of the information surface 16 on its path between the conical part of the laundry deflector 20 and the window cover 3.

In the illustrated exemplary embodiment the light to be transported by the light-conducting element 13 originates from a light source 17, similarly an LED, which is incorporated in the elastic sleeve 18. The sleeve 18 represents the flexible but moisture-tight connection between the housing opening in the front face 1 of the washing machine and an opening (not visible here) in a tub. Energy can be supplied to the LED 17 by way of fixed lines along the inside of the machine housing and the sleeve 18. The light-emitting element can however also be the end of a light-conducting element (not shown), which is connected in a fixed manner to the housing of the washing machine. Its or the light beams 19 of the LEDs 17 are directed onto the face of the laundry deflector 20, which lies opposite the light entry surface 15 of the light-conducting element 13.

The light radiated in can be colored, in order to convey a particular impression at the glass body of the bullseye door 2 compared with the otherwise white light. Its output can however also be controlled instead or additionally in order to convey particular signals. For example it can be used to output signals relating to the process sequence from the laundry care appliance.

If the information surface 16 has a short extension, a single light-emitting element 17 may be sufficient. More than one light element 17 is required for a more extended information surface 16 but the number of such light elements 17 required to illuminate the structure of the information surface 16 in a regular manner is much smaller due to the inventive arrangement of a light-conducting element 13 between laundry deflector 20 and window cover 3 than in the prior art.

The invention claimed is:

1. A lighting device on a laundry care appliance, the laundry care appliance comprising a loading opening and components made of a transparent or translucent material in the form of a pot-shaped laundry deflector and a window cover covering the loading opening lying at least approximately flush with the front face of the laundry care appliance, which bears lettering or a symbol, the lighting device comprising light-emitting elements arranged opposite lateral edge faces of at least one of the components, the light beams emitted by said elements being directed onto the edge faces and the lettering or symbol consisting of a three-dimensional structure in the material with an at least microscopically small extension into the material, wherein one of the components, which lies at least approximately flush with the front face of the laundry care appliance and is provided with the structure, has a light-conducting element that reaches inward out of the flush line, its light entry face reaching to the other component in the manner of an edge face and being guided into the radiation region of the light-emitting element.

2. The lighting device as claimed in claim 1, wherein the light entry face faces toward the radiation from the light-emitting element.

3. The lighting device as claimed in claim 1, wherein the light-emitting elements are LEDs or ends of light-conducting elements.

4. The lighting device as claimed in claim 1, wherein the elements are integrated in a frame which encloses the transparent or translucent material.

5. The lighting device as claimed in claim 1, wherein the light conducted in is colored.

6. The lighting device as claimed in claim 1, wherein the light output of the elements can be controlled.

7. The lighting device as claimed in claim 1, wherein the laundry care appliance comprises a washing machine or a tumble dryer.

8. A lighting device on a laundry care appliance, the laundry care appliance comprising a loading opening and components made of a transparent or translucent material in the form of a laundry deflector and a window cover covering the loading opening lying at least approximately flush with the front face of the laundry care appliance, which bears a three-dimensional structure, the lighting device comprising light-emitting elements arranged opposite lateral edge faces of at least one of the components, the light beams emitted by said elements being directed onto the edge faces and the-three-dimensional structure is provided with an at least microscopically small extension into the material, wherein one of the components, which lies at least approximately flush with the front face of the laundry care appliance and is provided with the structure, has a light-conducting element that reaches inward out of the flush line, its light entry face reaching to the other component in the manner of an edge face and being guided into the radiation region of the light-emitting element.

9. The lighting device as claimed in claim 8, wherein the light entry face faces toward the radiation from the light-emitting element.

10. The lighting device as claimed in claim 8, wherein the light-emitting elements are LEDs or ends of light-conducting elements.

11. The lighting device as claimed in claim 8, wherein the elements are integrated in a frame which encloses the transparent or translucent material.

12. The lighting device as claimed in claim 8, wherein the light conducted in is colored.

13. The lighting device as claimed in claim 8, wherein the light output of the elements can be controlled.

14. The lighting device as claimed in claim 8, wherein the laundry care appliance comprises a washing machine or a tumble dryer.

15. A lighting device on a laundry care appliance, the laundry care appliance comprising a loading opening and components made of a transparent or translucent material in the form of a pot-shaped laundry deflector and a window cover covering the loading opening lying at least approximately flush with the front face of the laundry care appliance, which bears lettering and a symbol, the lighting device comprising light-emitting elements arranged opposite lateral edge faces of at least one of the components, the light beams emitted by said elements being directed onto the edge faces and the lettering and symbol consisting of a three- dimensional structure in the material with an at least microscopically small extension into the material, wherein one of the components, which lies at least approximately flush with the front face of the laundry care appliance and is provided with the structure, has a light-conducting element that reaches inward out of the flush line, its light entry face reaching to the other component in the manner of an edge face and being guided into the radiation region of the light- emitting element.

* * * * *